US005735916A

United States Patent [19]

Lucas et al.

[11] Patent Number: 5,735,916

[45] Date of Patent: Apr. 7, 1998

[54] PROCESS FOR PRODUCTION OF LIGNIN FUEL, ETHYL ALCOHOL, CELLULOSE, SILICA/SILICATES, AND CELLULOSE DERIVATIVES FROM PLANT BIOMASS

[76] Inventors: James Lewis Lucas; Fred E. Martin, both of 3950 Via Real #265, Carpinteria, Santa Barbara, Calif. 93013

[21] Appl. No.: 713,127

[22] Filed: Sep. 16, 1996

Related U.S. Application Data

[63] Continuation-in-part of Ser. No. 460,493, Jul. 13, 1995, abandoned.

[51] Int. Cl.[6] ..... C10L 5/44

[52] U.S. Cl. ..... 44/605; 44/589

[58] Field of Search ..... 44/605

[56] References Cited

U.S. PATENT DOCUMENTS

| | | | |
|---|---|---|---|
| 4,797,135 | 1/1989 | Kubat et al. | 44/605 |
| 5,114,541 | 5/1992 | Bayer | 44/605 |
| 5,186,722 | 2/1993 | Cantrell et al. | 44/605 |

*Primary Examiner*—Ellen M. McAvoy

[57] ABSTRACT

This invention relates to a series of treatments, both physical and chemical, to plant biomass resulting in the production of ethanol, lignin, and a high protein animal feed supplement. In plants having a high silica content, a fourth product is obtained, silica/caustic oxide (silicates solution, waterglass.) Both the 5-Carbon and 6-Carbon sugars are fermented to ethanol using an existing closed-loop fermentation system employing a genetically engineered thermophilic bacteria developed by Agrol, Ltd. The lignin and absolute ethanol are mixed producing a high energy fuel.

5 Claims, No Drawings

PROCESS FOR PRODUCTION OF LIGNIN FUEL, ETHYL ALCOHOL, CELLULOSE, SILICA/SILICATES, AND CELLULOSE DERIVATIVES FROM PLANT BIOMASS

This application is a continuation in part of application Ser. No. 08/460,493, filed Jul. 13, 1995, now abandoned.

FIELD OF THE INVENTION

The invention relates to a method for producing lignin fuel (a mixture of lignin and ethyl alcohol), silica/sodium oxide, cellulose, and other cellulose derivatives from plant biomass.

BACKGROUND OF THE INVENTION

Description or Prior Art

The production of ethyl alcohol (ethanol) from 5-carbon and 6-carbon sugars has recently focused on the development of genetically engineered organisms. Prior to the work done in genetic engineering, considerable work was done with organisms, extraction of hydrolytic enzymes for cellulose and hemicellulose. B. S. Montencourt and D. E. Eveleigh, 1978, discussed producing fuels from plant biomass.

Delignification was done by Wilkes, et al., 1983, using chlorine dioxide/acetic acid solution.

Kubat et at., U.S. Pat. No. 4,797,135 describes a method of treating plant biomass with a weak caustic solution to produce a highly comminuted flour of wood and other vegetable biomass suitable for the use as fuel.

Many pretreatment technologies for the conversion of plant biomass, generally agricultural by-products (residues), have been developed in the past. The following institutions have provided work in plant biomass to fuels:

The U.S. Army Natick Development Command,

The University of California, Berkeley, Department of Engineering,

The Lawrence Berkeley Laboratory, and

The Indiana Institute of Technology (Spano, et al.)

The U.S. Pat. No. 4,399,009 (Haag, 1981) claims the conversion of biological materials to liquid fuels. This patent uses zeolite catalysts to convert plant hydrocarbons with a molecular weight of over 150 into lower molecular weight entities for use as a liquid fuel.

A gasoline fuel extender (methyltetrahydrofuran, MTHF) has been derived from plant biomass. MTHF, up to 10%, has been added to gasoline as a replacement for tetraethyl lead.

Generally, the production of alternative fuels have centered around aromatic compounds and are therefore relatively expensive.

A fuel derived from a mixture of ethyl alcohol (ethanol) and a lignin extract using a strong caustic solvent is an economically viable engine fuel.

REFERENCES CITED

The references cited within the text are incorporated by reference to the extent they supplement, explain, provide background for, or teach methodology, techniques, and compositions employed herein.

Haag, W. O., Rodewald, P. G. and Weisz, P. B., U.S. Pat. No. 4,300,009, Nov. 10, 1981. *A method of converting biological materials to liquid fuels.*

Montencourt, B. S. and Eveleigh, D. E., Proceedings of Second Annual Symposium on Fuels from Biomass, Vol. II, p 613, Rensseleaer. *Described strains of bacteria and fungi having cellulose hydrolyric capabilities*

Humphrey, A. E. and E. J. Nolan, Preport to the Office of Technology Assessment, Biological Production of Liquid Fuels and Chemical Feedstocks, Govt. Printing Office, #052-003-00706. *An economic evaluation of the Raphael Datzen Associates of the Gulf/Arkansas process.*

Wang, D. I. C., C. L. Coaney, A. L. Demain, R. F. Gomez, and A. J. Sinskey, "Degradation of Cellulosic Biomass and its Subsequent Utilization for the Production of Chemical Feedstocks,", September, 1979. *Studies done at M.I.T. on packed fixed bed cellulose conversions.*

Wilkes, C. W., "Process Development Studies on Bioconversion of Cellulose and Production of Ethanol", Univ. of California, Berkeley, LBL-6860. *Use of high temperature ethanol for removal of lignin from plant biomass and the use of ballmilling for size reduction on newsprint.*

Kubat et al., U.S. Pat. No. 4,797,135, *Treatment of plant biomass with a caustic solution for the production fuel.*

Bayer, Ernst, U.S. Pat. No. 5,114,541. *A process of producing solid liquid and gaseous fuels from biomass using high temperature* (200 degrees C. to 600 degrees C.)

OBJECT OF THE INVENTION

The object of this invention is to produce a continuos treatment of plant biomass using state-of-the-art counter-current extractors to extract salts, proteins and hemicellulose (first extractor); lignin and silica from the residue coming from the first extractor (second extractor); the separation of the lignin from the silicate using an ultrafiltration unit, in plants containing a high percentage of silica; the production of ethyl alcohol (ethanol) from the cellulose coming from the second extractor; and to produce a mixture of lignin and ethyl alcohol (ethanol) as a high energy fuel.

DETAILED DESCRIPTION OF THE INVENTION

This invention describes the technology for:

producing ethyl alcohol (ethanol);

a sulfur-free lignin powder;

in plants containing a high percentage of silica, a silicate solution known as silica/caustic oxide, waterglass, silicate, and;

a mixture of the sulfur-free lignin with ethanol producing a high energy fuel, and a high protein animal food supplement from the fermentation stillage The first step is size reduction of the plant material using an hammermill or ballmill to between 40 and 60 mesh, preferably 50 mesh.

The reduced size plant material is fed into a counter-current extractor. The solvent fed into the opposite end of the counter-current extractor has a pH of between 3.0 and 5.0, preferably pH of 4.0. The solvent temperature will be maintained between 40 and 60 degrees C., preferably 50 degrees C. The resident time of the solid biomass in the first counter-current extractor will be between 50 minutes and 70 minutes, preferably 60 minutes. The acids used to adjust to the solvent pH will be acetic, carbon dioxide (carbonic acid), hydrocholoric, phosphoric, or sulfuric, preferably carbonic acid. The solvent leaving the first counter-current extractor will contain xylose (and other 5-carbon "plant" sugars such as arabinose, and mannose), soluble salts generally found in plant material (calcium salts, sodium salts are examples), and soluble proteins and polypeptides found in plant biomass. This solvent stream is sent directly to a fermentation unit having organisms that convert the 5-Carbon sugars into ethyl alcohol (ethanol).

The solid material leaving the first counter-current extractor is fed directly into a second counter-current extractor after passing through a belt press filter. The total solids of the material entering the second counter-current extractor will be between 70% and 80%, preferably 75%. The solvent entering the opposite end of the counter-current extractor is a strong caustic solution either potassium hydroxide (KOH) or sodium hydroxide (NaOH), preferably NaOH, at a concentration of 5% to 50% solution by weight, preferably 50%. The temperature of the strong caustic solvent will be between 40 degrees C. and 60 degrees C., preferably 50 degrees C. The residence time of the solid material in the second counter-current extractor will be between 110 minutes and 130 minutes, preferably 120 minutes. This strong caustic solution dissolves the lignin, and, in the case of plant material contain a high percentage of silica, the silica is placed in solution as the caustic silicate.

The mixture of lignin and caustic silicate is fed to an ultrafiltration unit. This ultrafiltration unit has a polysulfone membrane which allows the caustic solution, or the caustic silicate solution, to pass through the membrane while retaining and concentrating the lignin. The lignin is concentrated to 38% to 42% total solid, preferably 40% total solid.

The ultrafiltration unit is of a special design where the polysulfone membrane is cast on the outside of a hollow ceramic core. The membrane and ceramic core are placed in a pressure vessel where the feed solution lignin—caustic solution or lignin—caustic silicate in plants having a high silica content, is passed over the membrane/ceramic core at a pressure, varying between 150 psig to 300 psig depending on concentration of lignin at a flow rate of 5 to 6 gallons per minute, depending on concentration of lignin. The concentrated lignin is washed to pH 7.0 to 6.5 with a target pH of 6.7. The lignin is then dried, ground into a high surface area powder approaching the surface area of powdered charcoal and then mixed with absolute (200 proof) ethyl alcohol (ethanol).

The caustic silicate solution that has passed through the polysulfone membrane is sent to a bleeder system when a portion of the caustic silicate is fed back, along with a replacement volume of strong caustic solution. The bled portion of the caustic silicate solution is packaged for sale as the caustic silicate (waterglass). In plants not having a high silica content, the caustic solution is returned to the $2^{nd}$ extractor.

The solid material (mostly cellulose) leaving the second counter-current extractor is sent to a continuous centrifuge equipped with water washing prior to entering the sacchrification and fermentation system. The sacchrification is done using both a weak solution of a mineral acid such as sulfuric or hydrochloric acid (pH 2 to 3 with pH 2.5 ideal) giving partial sacchrification. A hydrolytic sacchrification enzyme such as Rutgers University Rut-C-30 or other *Trichoderma reesei* (virde), preferably *T. reesei* (virde) is added to complete the conversion of the cellulose to its glucose monomers.

Fermentation of the 6-Carbon sugar (glucose) and the 5-Carbon sugars will be done using a genetically engineered bacteria, *Bacillus stearothermophilus* strain LLD-R This bacteria has been developed by Agrol, Ltd. (U.S. patent Ser. No. 51/82,199). The stillage from this bacterial fermentation process has been analyzed and show to be a high protein animal food supplement.

The "beer" leaving the fermentation unit has an ethyl alcohol (ethanol) concentration of between 3% and 5% with a target of 4%. This beer is sent to a distillation unit where the ethyl alcohol (ethanol) is distilled to 100% (200 proof). At this point the dried powdered lignin is mixed with the 200 proof ethyl alcohol (ethanol) producing the high energy fuel. The ratio of lignin to ethanol is between 3 parts ethanol to one part lignin and 3.8 parts of ethanol to 1 part lignin, preferably 3.5 parts ethanol to 1 part lignin.

The stillage produced by the Agrol, Ltd. bacteria has been analyzed and show to be a high protein animal food supplement.

Following is a mass flow for rice straw and/or rice hulls conversion using the technology outlined above:

Stream designations are

Stream #1—Ground rice straw (or other plant biomass) entering $1^{st}$ counter-current extractor, Stream #2—Mild acid solution entering opposite end of $1^{st}$ extractor, Stream #3—Solution of 5-Carbon sugars, soluble salts, proteins to fermentation unit, Stream #4—Solid materials leaving $1^{st}$ extractor and entering $2^{nd}$ extractor, Stream #5—Caustic solution and feedback solution from ultrafiltration unit entering $2^{nd}$ extractor, Stream #6—Cellulose entering hydrolysis/fermentation unit, Stream #7—Solution of lignin—caustic solution entering ultrafiltration unit, Stream #8—Caustic solution leaving ultrafiltration unit, Stream #8*a*.—Feedback solution of caustic solution into $2^{nd}$ extractor, Stream #8*b*—Silicate solution output, Stream #9—Lignin output, Stream #10—Lignin wash water, Stream #11—High protein animal food supplement, Stream #12—Ethanol output.

First Extraction

Dry rice straw and/or rice hulls, after being crushed in a mill is contacted (Stream #1) with a dilute acid stream in a counter-current extractor. The dilute acid is kept at a temperature of 50 degrees C. and is kept in contact with the crushed rice straw and/or rice hulls for one to two hours, preferably one and one-half hours. The 5-carbon sugars derived from the hydrolyzing of the hemicellulose is extracted. The crushed rice straw and/or rice hulls are passed through a filter press with a resulting material being 75% total solid (Stream #4). The 5-carbon sugar stream is sent directly to the fermentation unit (Stream #3).

Units included: hammer/ball mill, counter-current extractor, belt-press filter

Second Extraction

Wet straw is contacted with a high concentration of a caustic (40% to 60%, 50% preferred) solution at 50 degrees C. along with recycle (Stream #8*b*) containing the caustic silicate solution. Silica and lignin are solubilized; the silica combines with the caustic to form a silica/caustic oxide in a 1:1 ratio complex. The wet rice straw and/or rice hulls is centrifuged to 75% to 80% total solid, preferably to 77% total solid (Steam #6); The solid cellulose resulting from the extraction above is sent to Ethyl alcohol (ethanol) production (Stream #7).

Units included: counter-current extractor, centrifuge

Lignin Recovery

Lignin and the caustic silicate in solution are passed through an ultrafiltration unit. In stages, Lignin is isolated and concentrated, then washed to near neutrality (Stream #10) to recover the caustic/caustic oxide in solution. The caustic/caustic oxide solution is recycled in a 85:15 product/ recycle ratio (Stream #8A/8B). Lignin emerges as 65% total solid in water (Stream #9); Caustic/caustic oxide obtained as 50 mass % solution (Stream #8B).

Units included: Ultrafiltration unit(s), washing centrifuge

Ethyl Alcohol (Ethanol) Production and Isolation

Wet rice straw and/or rice hulls from the second extraction system (Stream #6) as well as filtrate from First Extraction (Stream #3) are fermented. Ethyl alcohol (ethanol) is purified to 100% (200 proof). Carbon dioxide and stillage from the fermentation process and water are removed (Stream #12).

Units included: Fermentor, Distillation unit

Energy Requirements for Rice Straw/Rice Hulls Conversion

Basis: 1 ton rice straw and/or rice hulls/hr.

Primary Energy Costs

Heating of solutions in both Extractor #1 and Extractor #2 is calculated at 317,000 BTU for Extractor #1, 185,000 BTU Extractor #2, and 2,000,000 BTU distillation for a total heat energy of 2,502,000 BTU/hr.

Secondary Energy Costs

Mechanical energy units for the Mill (102,000 BTU), Extractor #1 (25,500 BTU), Belt-Press Filter (51,000 BTU), Extractor #2 (51,000 BTU), Centrifuge (77,000 BTU), and Ultrafiltration (128,000 BTU) for a total mechanical energy of 435,000 BTU/hr.

Total Energy Costs 2,937,000 BTU/hr

Mass Flow (Mass in lbs/hr)

Water

Stream #1, 39.74 lbs.; Stream #2, 5,961 lbs; Stream #3, 5,599 lbs; Stream #4, 421.9 lbs; Stream #5, 421.9 lbs; Stream #6, 231.6 lbs; Stream #7, 699.7 lbs; Stream 8a, 89.9 lbs; Stream #8b 509.5 lbs; Stream #9, 536.9 lbs; Stream #10 436.6 lbs;

Soluble Components

Caustic

Streams #1 through #4, 0.0 lbs; Stream #5, 266.9 lbs; Stream #6, 8.1 lbs; Stream #7, 304.6 lbs; Stream #8, 304.6 lbs; Stream 8A, 45.7 lbs; Stream 8B, 258.9 lbs; Streams #9, #10, #11 and #12, 0.0 lbs;

Silica(Silica/Caustic oxide)

Streams #1 through #4, 0.0 lbs; Stream #5, 255.9 lbs; Stream #6, 8.1 lbs; Stream #7, 304.6 lbs; Stream #8, 304.6 lbs; Stream #8a, 45.7 lbs; Stream #8b, 258.9 lbs; Stream #9 and #10, 0.0 lbs.

Silica/Caustic oxide

Streams #1 through Stream #6, 0.0 lbs; Stream #7 and #8, 294.8 lbs; Stream #8a, 45.7 lbs; Stream #8b, 258.9 lbs; Streams #9 and #10, 0.0 lbs.

Lignin (in solution)

Streams #1 though #6, 0.0 lbs; Stream #7, 289.1 lbs; Streams #8a through Stream #10, 0.0 lbs.

TOTAL SOLUTION

Stream #1, 39.7 lbs; Stream #2, 5,961 lbs; Stream #3, 5,599.2 lbs; Stream #4, 401.5 lbs; Stream #5, 688.8 lbs; Stream #6, 221.6 lbs; Stream #7, 1,588.2 lbs; Stream #8, 1,198.8 lbs; Stream #8a, 179.8 lbs; Stream #8b, 1,018.9 lbs; Stream #9, 536.9 lbs; Stream #10, 436.6 lbs.

Insoluble Components

Cellulose

Stream #1, 635.8 lbs; Streams #2 and #3, 0.0 lbs; Stream #4, 635.8 lbs; Stream #5, 0.0 lbs; Stream #6, 635.8 lbs; Stream #7 through #10, 0.0 lbs.

Hemicellulose

Stream #1, 616.0 lbs; Stream #2, 0.0 lbs; Stream #3, 603.7 lbs; Stream #4, 12.3 lbs; Stream #5, 0.0 lbs; Stream #6, 12.3 lbs; Streams #7 through #10, 0.0 lbs;

Lignin

Stream #1, 298.1 lbs; Stream #2 and #3, 0.0 lbs; Stream #4, 298.1 lbs; Stream #5, 0.0 lbs; Stream #6, 8.9 lbs; Streams #7 through #8b, 0.0 lbs; Stream #9, 289.1 Stream #10, 0.0 lbs.

Silica

Stream #1, 258.3 lbs; Streams #2 and #3, 0.0 lbs; Stream #4, 258.3 lbs; Streams #5, 0.0 lbs; Stream #6, 7.8 lbs; Streams #7 through #10, 0.0 lbs.

Proteins

Stream #1, 99.4 lbs; Stream #2, 0.0 lbs; Stream #3, 99.4 lbs; Streams #4 through #10, 0.0 lbs.

Ash (less Silica)

Stream #1, 39.7 lbs; Stream #2, 0.0 lbs; Stream #3, 39.7 lbs; Streams #4 through #10, 0.0 lbs.

TOTAL SOLIDS

Stream #1, 1,947.3 lbs; Stream #2, 0.0 lbs; Stream #3, 742.7 lbs; Stream #4, 1,204.5 lbs; Stream #5, 0.0 lbs; Stream #6, 664.9 lbs; Streams #7 through #8b, 0.0 lbs; Stream #9, 289.1 lbs; Stream #10, 0.0 lbs.

TOTAL MASS

Stream #1, 1,987 lbs; Stream #2, 5,961 lbs; Stream #3, 6,342 lbs; Stream #4, 1,606 lbs; Stream #5, 688.8 lbs; Stream #6, 886.5 lbs; Stream #7, 1,588.2 lbs; Stream #8, 1,194.8 lbs; Stream #8a, 179.8 lbs; Stream #8b, 1,018.9 lbs; Stream #9, 826 lbs; Stream #10, 436.6 lbs.

PERCENT TOTAL SOLIDS

Stream #1, 98%, Stream #2, 0%, Stream #3, 12%; Stream #4, 75%; Stream #5, 0%; Stream #6, 75%; Stream #7 through #8b, 0%; Stream #9, 35%; Stream #10, 0%.

Note #1 There is a loss of 13 lbs in the milling process.

Note #2 344.4 lbs of the caustic solution forms the caustic oxide.

We claim:

1. A method for producing lignin fuel, silica/sodium oxide, cellulose, and cellulose derivatives from plant biomass comprising the steps of placing plant biomass in a hammermill or ball mill and grinding the plant biomass to 45 to 55 mesh, feeding the reduced size biomass into the first counter-current extractor, admixing the biomass with a mild acid solvent solution of acetic, carbonic, hydrochloric, phosphoric, or sulfuric acid at a temperature between 40 and 60 degrees C. and a residence time between 50 and 70 minutes, withdrawing a solvent stream from the first counter-current extractor containing 5-carbon sugars, soluble salts, soluble plant proteins, and soluble polypeptides which is passed to a fermentation tank where the 5-carbon sugars are fermented to ethanol, withdrawing a solid material stream from the first counter-current extractor and passing the solid material stream through a belt-press filter, dewatering the solid material to between 70% and 80% total solids, and feeding the dewatered solid material stream into a second counter-current extractor, admixing the solid material with a caustic hydroxide solution, dissolving the lignin and silica, withdrawing a solvent stream from the second counter-current extractor containing the lignin and caustic silicate and passing the solvent to an ultrafiltration membrane system, separating and concentrating the lignin from the solvent containing the caustic silicate solution, withdrawing from the ultrafiltration membrane unit a caustic silicate solution whereby a silica caustic oxide solution is produced, withdrawing between 10% and 20% of the caustic silicate solution from the ultrafiltration membrane unit and sending the caustic silicate solution to the caustic solvent added to the second counter-current extractor as a feed-back solvent, withdrawing the solid stream from the second counter-current extractor and passing the solid stream to a washing centrifuge, withdrawing the solid stream from the washing centrifuge and passing the solid to a belt-press filter dewatering the solid to 75% total solids, withdrawing the solid from the belt-press filter and passing the solid to a tank wherein the solid cellulose material is converted to a glucose stream using acid hydrolyzing enzymes, withdrawing the glucose liquid stream from the hydrolyzing solution and passing the glucose stream to a fermentation tank wherein the glucose is converted to ethanol, carbon dioxide, and water, withdrawing an ethanol stream from the fermentation tank and passing the ethanol solution to a distillation unit, withdrawing 200 proof (100%) ethanol stream from the distillation unit, passing the ethanol stream to a mixing tank wherein the lignin is mixed with the ethanol in a mixture ratio of 3.8 parts ethanol and 1.0 part lignin (weight/weight) ratio, withdrawing the solid from the fermentation tank consisting of spent fermentation organisms and sending these solids to dewatering and drying whereby producing a high protein animal feed, withdrawing the ethanol-lignin mixture from the mixing tank thereby producing a high energy petroleum-type fuel.

2. A method according to claim 1 wherein lignin and ethanol are mixed in a ration between 3.0 parts ethanol to 1.0 part lignin and 3.8 parts ethanol to 1.0 part lignin (weight/weight), thereby producing a petroleum-like fuel.

3. A method according to claim 1 of wherein the plant biomass is selected from the group consisting of barley straw and barley hulls; corn stover and corn cobs; cotton stalks, cotton bowls, cotton gin mill blow wastes; forest slashings and saw mill wastes; rice straw and rice hulls; wheat straw and wheat hulls; or yard and orchard clippings.

4. A method according to claim 1 wherein the lignin extraction solvent comprises sodium hydroxide or potassium hydroxide as the solvent for extraction of lignin and silica, wherewith the solvent is sent to an ultrafiltration membrane system wherein the lignin is separated and concentrated and the silica/caustic oxide passes through the membrane.

5. A method according to claim 1 wherein the acid used to adjust the pH of the extracting solvent in the first extractor is carbonic, hydrochloric or sulfuric.

* * * * *